US005301828A

United States Patent [19]

McKay

[11] Patent Number: 5,301,828

[45] Date of Patent: Apr. 12, 1994

[54] SECONDARY SHOE SEAL

[75] Inventor: Donald W. McKay, Chadds Ford, Pa.

[73] Assignee: HMT, Inc., Houston, Tex.

[21] Appl. No.: 922,037

[22] Filed: Jul. 29, 1992

[51] Int. Cl.[5] ..... B65D 88/42

[52] U.S. Cl. ..... 220/221; 220/216; 220/222

[58] Field of Search ..... 220/216, 218, 221, 222, 220/224, 578, 225, 226

[56] References Cited

U.S. PATENT DOCUMENTS

| | | | |
|---|---|---|---|
| 1,861,860 | 6/1932 | Horton | 220/221 X |
| 2,634,017 | 4/1953 | Moyer | 220/222 |
| 2,740,549 | 4/1956 | Graham et al. | 220/222 |
| 2,840,260 | 6/1958 | Wiggins | 220/224 |
| 4,258,858 | 3/1981 | Russell | 220/222 |
| 4,287,999 | 9/1981 | Heisterberg | 220/222 |
| 4,308,968 | 1/1982 | Thiltgen et al. | 220/222 |
| 4,353,477 | 10/1982 | Bruening | 220/224 |
| 4,371,090 | 2/1983 | Ogarek et al. | 220/224 |
| 4,397,399 | 8/1983 | Wagoner | 220/222 |
| 4,811,859 | 3/1989 | Kinghorn, Jr. | 220/224 |
| 5,036,995 | 8/1991 | Wagoner | 220/224 |
| 5,078,293 | 1/1992 | Lippiello | 220/221 |
| 5,103,992 | 4/1992 | Lippiello et al. | 220/221 |

*Primary Examiner*—Allan N. Shoap
*Assistant Examiner*—Vanessa Caretto
*Attorney, Agent, or Firm*—Spensley Horn Jubas & Lubitz

[57] ABSTRACT

The space between the inner wall of a petroleum or hydrocarbon tank or similar storage tank and a floating roof therein is sealed by both a primary seal and a secondary seal. The secondary seal, which has no elastomeric parts subject to rapid deterioration, includes a flexible vapor barrier fabric having a first edge coupled to the floating roof and an opposite second edge. The secondary seal further includes a plurality of plates disposed above the vapor barrier fabric and having lower ends coupled to the floating roof and opposite upper ends coupled to a metal shoe disposed against the inner tank wall and having the second edge of the vapor barrier fabric coupled thereto. The length of each metal plate between upper and lower edges thereof is adjustable by virtue of the plate being comprised of overlapping upper and lower plates joined by bolts in elongated apertures therein. The shoe is flexibly coupled to the upper edges of the plates by bolts disposed within dimpled holes in the shoe and in the upper edges of the plates.

14 Claims, 3 Drawing Sheets

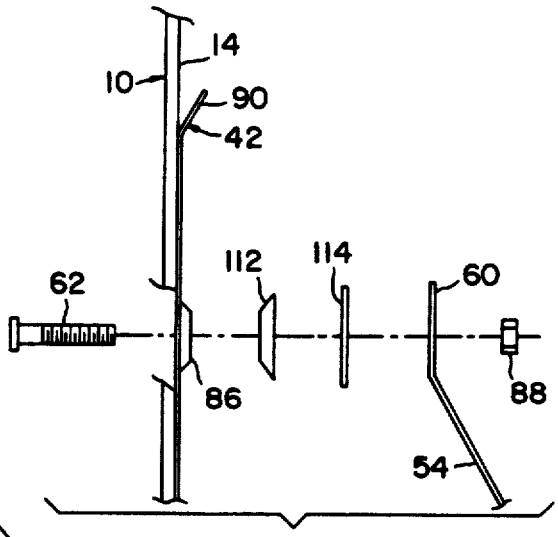
FIG. 9
FIG. 10
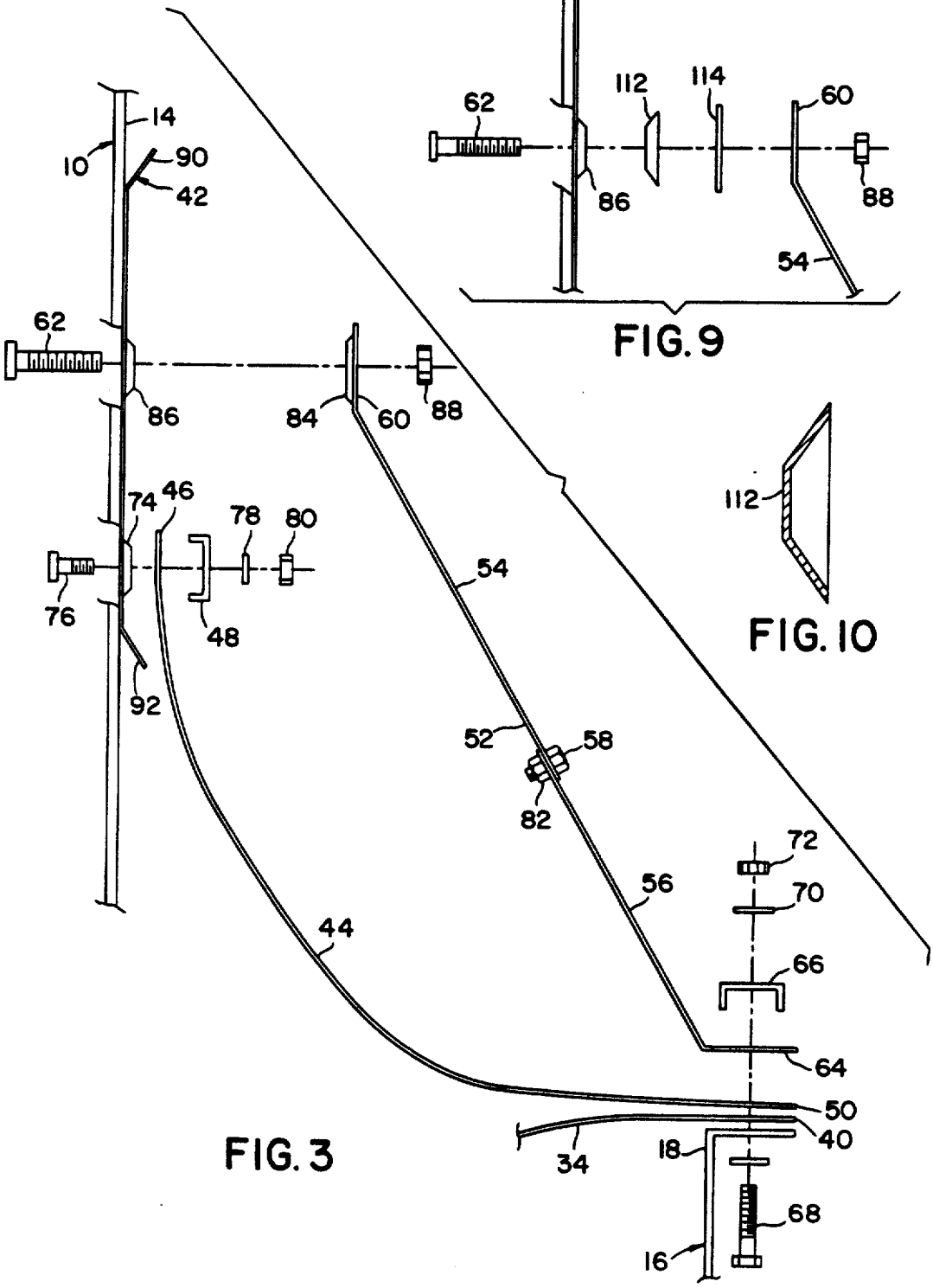
FIG. 3

SECONDARY SHOE SEAL

BACKGROUND OF THE INVENTION

1. Field of the Invention

The present invention relates to seals for the floating roofs of storage tanks for petroleum and similar products, and more particularly to an improved secondary seal for use in conjunction with a primary seal.

2. History of the Prior Art

Seals for sealing the space between a floating roof and the inner tank wall of a petroleum storage tank are well known and have been provided in a variety of different configurations. Examples of such seals are provided by U.S. Pat. Nos. 4,308,968, 5,078,293 and 5,103,992, all of which are commonly assigned with the present application. It is common practice in many applications to provide a tank with both a primary seal and a secondary seal. The primary seal is regarded as providing the primary or principal sealing function of the space between the floating roof and the inner tank wall. The secondary seal, which is often installed after the primary seal is in place and the tank has been in service for some time, provides a backup sealing function. Typically, the secondary seal is disposed above the primary seal in order to trap any vapors which may escape through the primary seal. The 1968 patent noted above provides an example of a secondary seal, while the '293 and '992 patents noted above provide examples of primary seals.

The secondary seal described in the '968 patent noted above includes a plurality of overlapping metal plates which have their lower edges mounted on the floating roof and which extend toward the inner tank wall so as to terminate in upper edges disposed adjacent the inner tank wall. A plurality of flexible wiper blades mounted on the upper edges of the overlapping metal plates extend into contact with the inner tank wall. Depending upon whether the tank is of welded or riveted construction, the wiper blades may assume different configurations to accommodate the smoother walls of a welded tank or the irregular wall surfaces of a riveted tank. A vapor barrier fabric disposed beneath the overlapping metal plates has a first edge thereof coupled to the floating roof and an opposite second edge coupled to the upper edges of the overlapping metal plates where the wiper blades are mounted. The vapor barrier fabric seals the space beneath the overlapping metal plates. The overlapping metal plates support the wiper blade arrangement which seals the space beneath the overlapping metal plates at the inner tank wall. U.S. Pat. No. 4,397,399 provides a further example of a seal having a vapor barrier fabric in conjunction with overlapping metal plates which support a single wiper blade.

Secondary seals of the type described in the '968 patent noted above provide effective sealing action, particularly when compared with certain other seal designs including earlier roof seals. However, the elastomeric material typically used for the wipers is subject to relatively rapid deterioration which can greatly shorten the life of the seal that would be otherwise realized with the metal parts thereof. Most elastomers that are resistant to abrasion and other typical tank service conditions are subject to relatively rapid deterioration when exposed to certain gasoline additives and chemicals such as MTBE and benzene. On the other hand, the vapor barrier fabrics are not subject to abrasion, as are the wiper blades, and can be made of laminated fluoropolymers such as Teflon which are resistant to virtually all products stored in floating roof tanks.

Accordingly, it would be desirable to provide an improved secondary seal for floating roof tanks. A more specific object would be the provision of a secondary seal which is free of elastomers or other materials that may be subject to rapid deterioration.

BRIEF SUMMARY OF THE INVENTION

Secondary roof seals for floating roof tanks, in accordance with the invention, are designed so as to avoid the use of elastomers or other materials normally subject to rapid deterioration. More particularly, such secondary seals employ a metal shoe in contact with the inner tank wall in conjunction with a plurality of support plates mounted on the floating roof. A vapor barrier fabric disposed beneath the support plates extends between and seals the space between the floating roof and the shoe.

In a preferred arrangement of a secondary seal according to the invention, a plurality of plates have the lower ends thereof mounted on the floating roof and extend to opposite upper ends disposed adjacent the inner tank wall. The upper ends of the plates are coupled to a metal shoe having a major surface thereof disposed against the inner tank wall. A vapor barrier fabric extends between the floating roof and the shoe beneath the plates. A first edge of the vapor barrier fabric is coupled to the floating roof and an opposite second edge thereof is coupled to the shoe.

The plates, which are spaced apart from each other, have a length between the lower and upper edges thereof which is adjustable to accommodate varying distance between the floating roof and the inner tank wall around the periphery of the floating roof. Adjustability is provided by fashioning each of the plates from upper and lower plates joined together by bolts disposed within elongated apertures in the plates. By loosening the bolts, the upper plate can be adjustably positioned relative to the lower plate to vary the length of the plate formed thereby.

A flexible coupling of the shoe to the upper ends of the plates is provided by a coupling arrangement which utilizes dimpled holes in the shoe and in the upper edges of the metal plates. Bolts extend through the dimpled holes in the shoe and in the upper edges of the metal plates. In an alternative arrangement for flexibly coupling the shoe to the upper ends of the plates, a concave spring washer is disposed together with a flat washer between the plate upper end and a dimpled hole in the shoe through which a bolt extends to receive the spring washer and flat washer and the plate upper end.

BRIEF DESCRIPTION OF THE DRAWINGS

A better understanding of the invention may be had by reference to the following specification in conjunction with the accompanying drawings in which:

FIG. 3 is an exploded end view of the arrangement of FIG. 2;

FIG. 9 is an exploded end view similar to FIG. 3 and showing an alternative arrangement for flexibly mounting the shoe of the secondary seal; and FIG. 10 is a sectional view of a spring washer used in the arrangement of FIG. 9.

DETAILED DESCRIPTION

Figure 1:
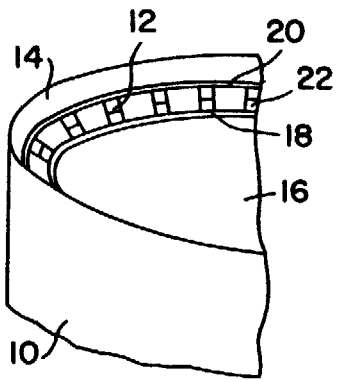
FIG. 1 is a perspective view of a portion of a tank having a secondary seal in accordance with the invention.

FIG. 1 depicts a tank 10 utilizing a secondary seal 12 in accordance with the invention. The tank 10 is generally cylindrical in configuration, and may comprise a petroleum or hydrocarbon storage tank or similar tank for storing a volatile liquid. The secondary seal 12 is disposed between and seals the space between an inner wall 14 of the tank 10 and a circular roof 16 which floats on the surface of the gasoline, oil or other liquid product in the tank 10. As described in detail hereafter, the secondary seal 12 is disposed above a primary seal and extends between a rim 18 at the outer periphery of the circular floating roof 16 and the inner wall 14 of the tank 10. The secondary seal 12 has a flexible support structure 22 which terminates in an upper lip 20 adjacent the inner wall 14 of the tank 10. As also described in detail hereafter, the support structure 22 is comprised of metal plates which are both flexible and adjustable to accommodate variations in the space between the rim 18 of the floating roof 16 and the inner wall 14 of the tank 10. The upper lip 20 is formed by the upper edges of the metal plates which support a shoe and bias a major surface portion of the shoe against the inner tank wall 14.

Figure 2:
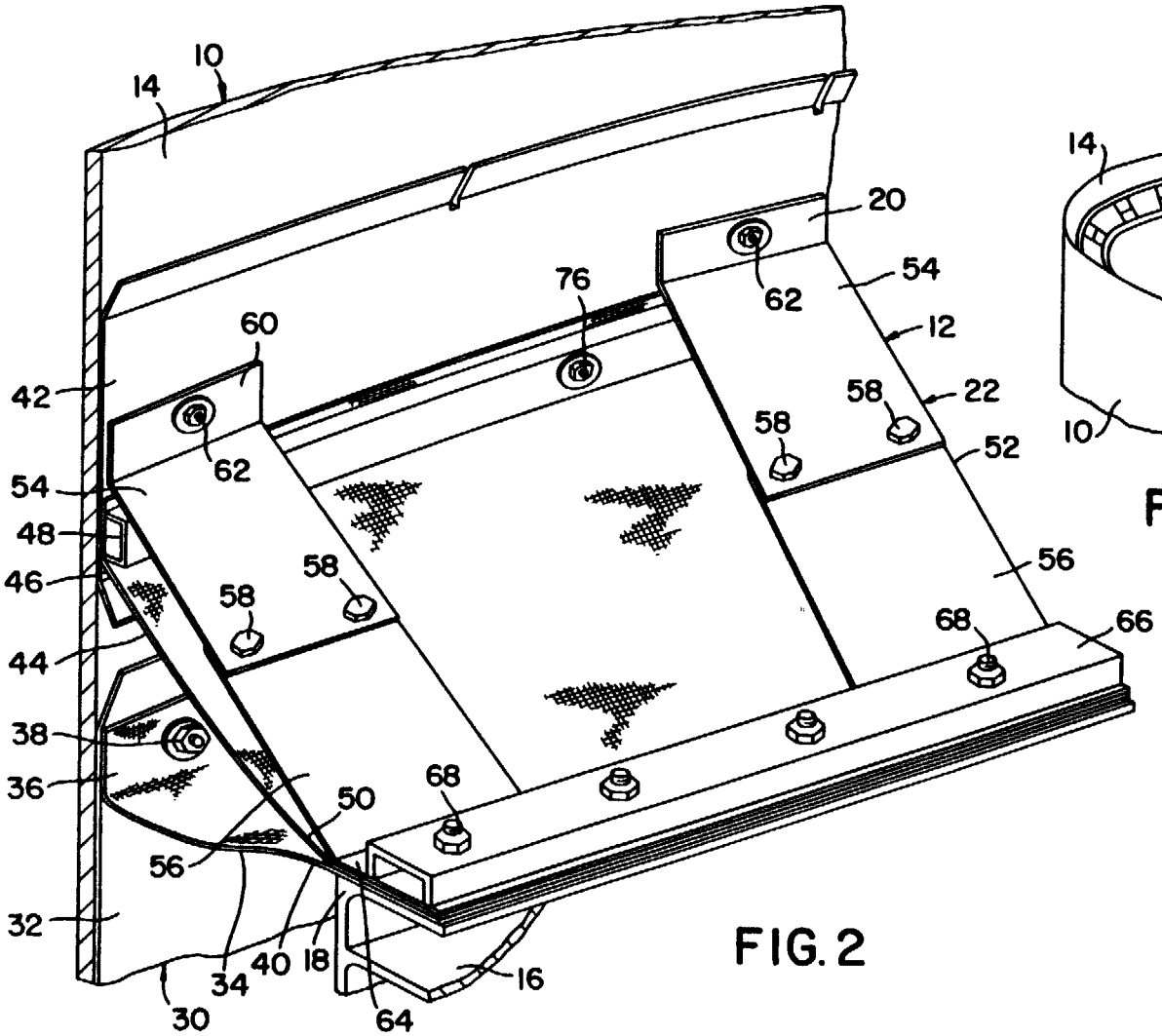
FIG. 2 is a perspective view of the secondary seal of FIG. 1 together with a portion of a primary seal.

Referring to FIG. 2, the floating roof 16 has a primary seal 30 extending between the rim 18 thereof and the inner wall 14 of tank 10 to provide primary sealing of the space therebetween. In the present example, the primary seal 30 includes a shoe 32 disposed against the inner wall 14 of the tank 10 and a length of vapor barrier fabric 34. The vapor barrier fabric 34 has a first edge 36 thereof coupled to an upper portion of the shoe 32 such as by a plurality of bolts 38. The vapor barrier fabric 34 extends across the space between the shoe 32 and the rim 18 of the floating roof 16, where the vapor barrier fabric 34 terminates in an opposite second edge 40. The second edge 40 is coupled to the rim 18.

The primary seal 30, which is only partially illustrated in FIG. 2, can assume any appropriate form. As previously noted, the primary seal 30 provides primary sealing of the space between the inner wall 14 of the tank 10 and the floating roof 16. However, because of the advantages of the secondary seal 12 in accordance with the invention, it is preferred that the primary seal 30 be of the type that does not utilize elastomers that must be resistant to abrasion. Abrasion-resistant elastomers are typically subject to relatively rapid deterioration when exposed to certain gasoline additives and chemicals such as MTBE and benzene. For this reason, the primary seal 30 illustrated in FIG. 2 utilizes the shoe 32 in conjunction with the vapor barrier fabric 34. Because the vapor barrier fabric 34 is not subject to abrasion, the fabric 34 can be made of laminated fluoropolymers such as Teflon which are resistant to virtually all products stored in floating roof tanks. Previously referred to U.S. Pat. No. 5,103,992 illustrates such a primary seal in which the shoe is adjustably mounted on the floating roof by a series of spaced apart scissors hanger assemblies and in which resilient bars or plates disposed between the floating roof and the shoe bias the shoe into contact with the inner tank wall.

In accordance with the invention, the secondary seal 12 also avoids the use of elastomeric materials of the type subject to relatively rapid deterioration. This is accomplished using a shoe 42 and the support structure 22 therefore in combination with a vapor barrier fabric 44. The vapor barrier fabric 44 has a first edge 46 thereof secured to a lower portion of the shoe 42 using a channel 48. As described hereafter in connection with FIG. 3, the channel 48 is fastened to the shoe 42 by a plurality of bolts, to secure the first edge 46 of the vapor barrier fabric 44 thereon. The vapor barrier fabric 44 extends between the shoe 42 at the inner wall 14 of the tank 10 and the floating roof 16. The vapor barrier fabric 44 has a second edge 50 opposite the first edge 46 thereof secured to the rim 18 of the floating roof 16.

The vapor barrier fabric 44 which extends between the shoe 42 and the floating roof 16 serves to trap any vapors which may escape through the primary seal 30. Because the vapor barrier fabric 44 is not subject to abrasion, it can be made of materials such as laminated fluoropolymers which are resistant to virtually all products stored in floating roof tanks, including gasoline additives and chemicals such as MTBE and benzene.

As the level of the liquid product within the tank 10 varies, the shoe 32 of the primary seal 30 and the shoe 42 of the secondary seal 12 slide upwardly and downwardly along the inner wall 14 of the tank 10. The shoe 42 is supported by the support structure 22. The support structure 22 biases the shoe 42 into contact with the inner wall 14. In addition, the support structure-22 has sufficient flexibility and adjustability to accommodate differences in the space between the outer rim 18 of the floating roof 16 and the inner tank wall 14 around the circumference of the circular floating roof 16.

The support structure 22 is comprised of a series of spacedapart plates 52 of resiliently flexible material such as stainless steel. Each of the plates 52 is comprised of an upper plate 54 and a lower plate 56. The upper plate 54 is joined to the corresponding lower plate 56 by a pair of bolts 58 which permit adjustment of the total height of the plate 52, as described hereafter in connection with FIGS. 6 and 7. Each upper plate 54 has an upper edge 60 thereof which is bent at an angle relative to the rest of the plate 54 and which is joined to an intermediate portion of the shoe 42 by a bolt 62. Each lower plate 56 has a lower edge 64 thereof which extends beneath a channel 66 just above the outer rim 18 of the floating roof 16.

The second edge 40 of the vapor barrier fabric 34 and the second edge 50 of the vapor barrier fabric 44 are disposed between the lower edges 64 of the lower plates 56 and the rim 18 of the floating roof 16, where they are secured together with the lower edges 64 of the lower plates 56 by the channel 66. The channel 66 is clamped to the rim 18 by a plurality of bolts 68. Although a horizontal mount configuration is shown in which the vapor barrier fabrics 34 and 44 and the plate lower edge 64 are joined to a horizontal portion of the floating roof 18, it should be understood that a vertical mounting arrangement can also be used.

In the present example, the plates 52 are spaced-apart from each other around the rim 18 of the roof 16. For most applications, the vapor barrier fabric 44 is capable of exposure to the outside elements and does not have to be covered. However, the plates 52 can be mounted so that their side edges overlap to form a continuous cover for the vapor barrier fabric 44 where desired.

Where the plates 52 are spaced-apart as in the present example, cover plates may be used to cover the plates 52. The cover plates need not be 2-piece as are the plates 52, and can be of different shape.

Further details of the arrangement of FIG. 2 are shown in the exploded end view of FIG. 3. As shown therein, the second edge 40 of the vapor barrier fabric 34 and the second edge 50 of the vapor barrier fabric 44 are sandwiched between the rim 18 of the floating roof 16 and the lower edges 64 of the lower plates 56 by the channel 66. The bolts 68 extend upwardly through apertures in the rim 18, the second edges 40 and 50 of the vapor barrier fabrics 34 and 44, the lower edges 64 of the lower plates 56 and the channel 66, where they receive washers 70 and nuts 72.

The opposite first edge 46 of the vapor barrier fabric 44 is secured to a lower portion of the shoe 42 by the channel 48, in conjunction with a plurality of apertured dimples 74 in the lower portion of the shoe 42. A plurality of bolts 76 extend through apertures in the dimples 74, through apertures in the first edge 46 of the vapor barrier fabric 44, and through apertures in the channel 48, where they receive washers 78 and nuts 80.

As previously noted, each upper plate 54 is joined to the lower plate 56 associated therewith by a pair of the bolts 58. As shown in FIG. 3, the bolts 58 extend through apertures in the upper plate 54 and the lower plate 56 where they receive a nut 82.

The upper edges 60 of the upper plates 54 are provided with apertured dimples 84 for interfacing with apertured dimples 86 spaced along an intermediate portion of the shoe 42. Each of the bolts 62 extends through one of the apertured dimples 86 and an associated one of the apertured dimples 84, where it receives a nut 88.

The dimples 84 in the upper edges 60 of the upper plates 54 and the interfacing dimples 86 in the shoe 42 comprise one arrangement for providing the needed articulation between the upper plates 54 and the shoe 42. This provides a relatively tight fit of the broad surface area of the shoe 42 against the inner wall 14 of the tank 10 under a variety of conditions including varying distance between the rim 18 of the floating roof 16 and the inner tank wall 14 around the circumference of the floating roof 16. The resiliently flexible nature of the upper and lower plates 54 and 56 combines with such articulated coupling of the upper edges 60 of the upper plates 54 to the shoe 42 to resiliently bias the shoe 42 against the inner tank wall 14 in the face of such varying conditions.

Figure 4:
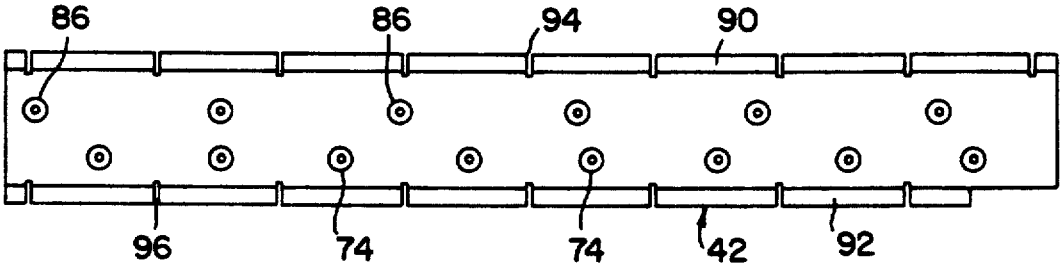
FIG. 4 is a plan view of a shoe forming a part of the secondary seal of the arrangement of FIG. 2.

The shoe 42 is shown in greater detail in FIG. 4. FIG. 4 shows a section of the shoe 42 which has opposite ends that overlap the ends of similar sections so as to form the continuous shoe 42 around the circumference of the inner tank wall 14. The upper and lower edges of the shoe 42 are bent in order to form beveled edges 90 and 92 respectively. As shown in FIG. 3, the upper and lower beveled edges 90 and 92 of the shoe 42 are angled away from the inner wall 14 of the tank 10 to facilitate sliding movement of the shoe 42 over the wall 14. To accommodate the slight curvature of the inner tank wall 14 against which the shoe 14 must reside in close-fitting contact, the beveled edges 90 and 92 are provided with a series of spaced-apart slots 94 and 96 respectively.

Figure 5:
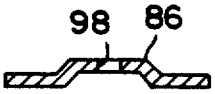
FIG. 5 is a sectional view of a portion of the shoe of FIG. 4 showing the details of one of the apertured dimples therein.

As previously described, the shoe 42 is provided with the apertured dimples 86 along an intermediate portion thereof. Such apertured dimples 86 are shown in FIG. 4, with one such dimple 86 being shown in detail in the cross-sectional view of FIG. 5. As shown in FIG. 5, the dimple 86 is of generally circular configuration and is raised or off-set from the plane of the shoe 42. An aperture 98 extends through a central portion of the dimple 86 to receive one of the bolts 62 shown in FIGS. 2 and 3.

Figure 8:
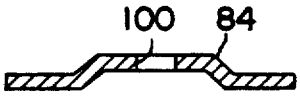
FIG. 8 is a sectional view of a portion of the upper plate of FIG. 6 showing the details of one of the apertured dimples therein.
Figure 6:
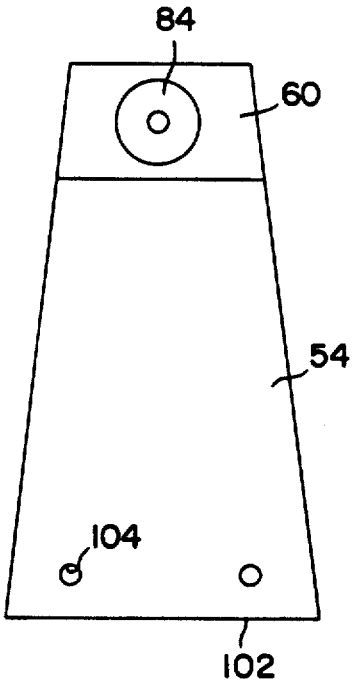
FIG. 6 is a plan view of one of the upper plates used in the secondary seal of the arrangement of FIG. 2.

Each of the dimples 86 in the shoe 42 receives a different one of the apertured dimples 84 in the upper edge 60 of one of the upper plates 54. FIG. 6 shows one of the upper plates 54 in detail, with the apertured dimple 84 thereof being shown in detail in the cross-sectional view of FIG. 8. Like the dimple 86 in the shoe 42, the dimple 84 in the upper edge 60 of the upper plate 54 is of generally circular configuration and is off-set from the plane of the upper edge 60. A central aperture 100 therein receives one of the bolts 62.

As shown in FIG. 6, the upper plate 54 has a tapering width which increases from the upper edge 60 to an opposite lower edge 102 thereof, in the present example. However, the upper plate 54 can be of rectangular shape, in which event the width thereof is uniform. The upper plate 54 has a pair of apertures 104 therein adjacent the lower edge 102 to receive the bolts 58.

Figure 7:
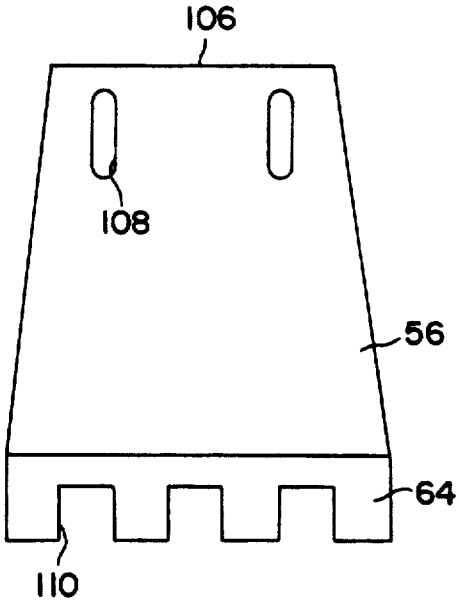
FIG. 7 is a plan view of one of the lower plates used in the secondary seal of the arrangement of FIG. 2.

One of the lower plates 56 is shown in detail in FIG. 7. Like the upper plate 54, the lower plate 56 has a tapering width which increases from an upper edge 106 thereof to the opposite lower edge 64 thereof. However, the lower plate 56 can be of rectangular configuration and have a uniform width where desired. The width of the lower plate 56 at the upper edge 106 thereof is approximately equal to the width of the upper plate 54 at the lower edge 102 thereof. The lower plate 56 is provided with a pair of elongated apertures 108 therein adjacent the upper edge 106 thereof. The elongated apertures 108 receive the bolts 58 mounted within the apertures 104 in the upper plate 54. The nuts 82 are secured on the bolts 58 outside of the apertures 108. The apertures 108 in the lower plate 56 are elongated in configuration to permit adjustment. With the nuts 82 untightened, the bolts 58 are free to slide within the apertures 108 to vary the positioning of the lower edge 102 of the upper plate 54 over the upper edge 106 of the lower plate 56. In this manner, the combined height of the combined upper plate 54 and lower plate 56 can be varied or adjusted to compensate for variations in the distance between the rim 18 of the floating roof 16 and the inner tank wall 14 around the circumference of the circular floating roof 16.

As shown in FIG. 7, the lower edge 64 of the lower plate 56 is provided with a plurality of slots 110 therein for receiving the bolts 68.

FIG. 9 shows an alternative arrangement for flexibly coupling the shoe 42 to the upper edge 60 of the upper plate 54. As in the case of FIG. 3, the shoe 42 is provided with the dimple 86 through which the bolt 62 passes. In addition, however, a concave spring washer 112 and a flat washer 114 are disposed between the dimple 86 and the upper edge 60 and receive the bolt 62. The nut 88 is then mounted on the bolt 62. As shown in the cross-sectional view of FIG. 10, the spring washer 112 may be of the Belleville type so as to be of concave configuration. This enables the spring washer 112 to flex to a necessary extent to provide the needed flexibility between the shoe 42 and the upper plate 54.

It will be apparent to those skilled in the art that various different arrangements can be used to couple the shoe 42 to the overlapping plates 52 in flexible, articulating fashion.

It is frequently necessary or desirable to provide a floating roof seal with a metal shunt or other means for draining static electricity from the floating roof 16 to the tank wall 14. In the case of the secondary seal 12, such shunting action is provided by the seal itself. The metal shoe 42 which contacts the tank wall 14 is coupled by the metal bolt 62 to the upper edge 60 of the upper plate 54. The upper plate 54 is in direct contact with the lower plate 56, the lower edge 64 of which is coupled by the metal bolt 68 to the floating roof 16. Thus, a conductive path is provided between the floating roof 16 and the tank wall 14, to shunt static electricity. Such a shunt can also be provided by the vapor barrier fabric 44 which extends between the metal shoe 42 and the floating unit 16. The vapor barrier fabric 44 may be comprised partly of carbon or other conductive material, so that the vapor barrier fabric 44 itself acts as a shunt for static electricity.

While the invention has been particularly shown and described with reference to a preferred embodiment thereof, it will be understood by those skilled in the art that other changes in form and details may be made therein without departing from the spirit and scope of the invention.

I claim:

1. An arrangement for sealing a space between an inner wall of a tank and a floating roof therein comprising the combination of:

a primary seal mounted on the floating roof and extending into contact with the inner wall of the tank to provide primary sealing of the space between the inner wall of the tank and the floating roof; and a secondary seal disposed above the primary seal, the secondary seal being mounted on the floating roof and extending into contact with the inner wall of the tank above the primary seal to provide secondary sealing of the space between the inner wall of the tank and the floating roof, the secondary seal including a shoe disposed against the inner wall of the tank and supported on the floating roof.

2. The invention set forth in claim 1, wherein the secondary seal further includes a flexible sealing membrane extending between the floating roof and the shoe.

3. The invention set forth in claim 2, wherein the flexible sealing membrane compress a vapor barrier fabric having a first edge coupled to the floating roof and an opposite second edge coupled to the shoe.

4. The invention set forth in claim 1, wherein the shoe is supported on the floating roof by a plurality of plates mounted on the floating roof and extending to and coupled to the shoe.

5. The invention set forth in claim 4, wherein the plates have a length between the floating roof and outer edges thereof adjacent the shoe which is adjustable to adjust for variations in the space between the floating roof and the inner wall of the tank around the floating roof.

6. The invention set forth in claim 4, wherein each of the plurality of plates is comprised of an opposite pair of plates adjustably coupled to each other at overlapping edges thereof.

7. The invention set forth in claim 4, wherein the plurality of plates are coupled to the shoe by flexible couplings.

8. A storage tank having a secondary seal, comprising the combination of:

a storage tank having an inner wall;

a floating roof disposed within the storage tank adjacent the inner wall;

a primary seal providing primary sealing of a space between the floating roof and the inner wall of the storage tank; and a secondary seal providing secondary sealing of the space between the floating roof and the inner wall of the storage tank, the secondary seal being disposed above the primary seal and comprising a flexible sealing membrane disposed above the primary seal and having a first edge coupled to the floating roof and an opposite second edge, a plurality of plates disposed above the sealing membrane and each having a first edge coupled to the floating roof and an opposite second edge disposed adjacent the inner wall of the storage tank, and a metal shoe disposed against the inner wall of the storage tank and coupled to the second edges of the plurality of plates, the second edge of the flexible sealing membrane being coupled to the shoe.

9. The invention set forth in claim 8, wherein the shoe is coupled to the second edges of the plurality of plates by flexible couplings.

10. The invention set forth in claim 9, wherein the flexible couplings include dimpled holes in the shoe, dimpled holes in the second edges of the plurality of plates and bolts extending through the dimpled holes in the shoe and the dimpled holes in the second edges of the plurality of plates.

11. The invention set forth in claim 9, wherein the flexible couplings include a plurality of spring washers disposed between the shoe and the second edges of the plurality of plates and bolts extending through the spring washers between the shoe and the second edge of the plurality of plates.

12. The invention set forth in claim 11, further including a plurality of flat washers disposed between the plurality of spring washers and the second edges of the plurality of plates, and wherein the plurality of spring washers are of concave configuration.

13. The invention set forth in claim 8, wherein each of the plurality of plates has a length between the first and second edges thereof which is adjustable.

14. The invention set forth in claim 13, wherein each of the plurality of plates comprises an opposite pair of plates joined by bolts at elongated apertures in overlapping edges thereof.

* * * * *